US007138900B2

(12) United States Patent
Liu et al.

(10) Patent No.: US 7,138,900 B2
(45) Date of Patent: Nov. 21, 2006

(54) RESETABLE OVER-CURRENT PROTECTION DEVICE AND METHOD OF MAKING THE SAME

(75) Inventors: Wen-Lung Liu, Taipei (TW); Chi-Hao Chiu, Taipei (TW); Kang-Neng Hsu, Hsinchu Hsien (TW); Szu-Lung Sun, Hsinchu (TW)

(73) Assignee: Inpaq Technology Co., Ltd., Miao Li Hsien (TW)

( * ) Notice: Subject to any disclaimer, the term of this patent is extended or adjusted under 35 U.S.C. 154(b) by 205 days.

(21) Appl. No.: 10/853,617

(22) Filed: May 25, 2004

(65) Prior Publication Data

US 2004/0252433 A1 Dec. 16, 2004

(30) Foreign Application Priority Data

Jun. 10, 2003 (TW) ..... 92115677 A

(51) Int. Cl.
*H01C 7/10* (2006.01)

(52) U.S. Cl. ..... 338/22 R; 338/314

(58) Field of Classification Search ..... 338/13, 338/20, 21, 22 R, 25, 30, 68, 71, 72, 203, 338/204, 205, 312–314, 328, 332
See application file for complete search history.

(56) References Cited

U.S. PATENT DOCUMENTS 5,864,281 A * 1/1999 Zhang et al. ..... 338/312
6,686,827 B1 * 2/2004 Chen et al. ..... 338/312
6,854,176 B1 * 2/2005 Hetherton et al. ..... 338/332

* cited by examiner

*Primary Examiner*—Tu Hoang
(74) *Attorney, Agent, or Firm*—Ladas and Parry LLP

(57) ABSTRACT

The present invention relates to a resetable over-current protection device. The device is characterized in that: disconnected areas are maintained at end faces of formed cutting regions of the protection device, wherein one or two of the end faces of the formed cutting regions are partly formed with electrically conductive layers so as to increase the lifespan of the device and allows easy manufacturing of the device. The present invention also provides a method of manufacturing the resetable over-current protection device. The method is characterized in that a polymer-based sheet is divided into a plurality of components from which resetable over-current protection devices are subsequently manufactured into the resetable over-current protection devices to save the cost of material.

14 Claims, 8 Drawing Sheets

PRIOR ART

PRIOR ART

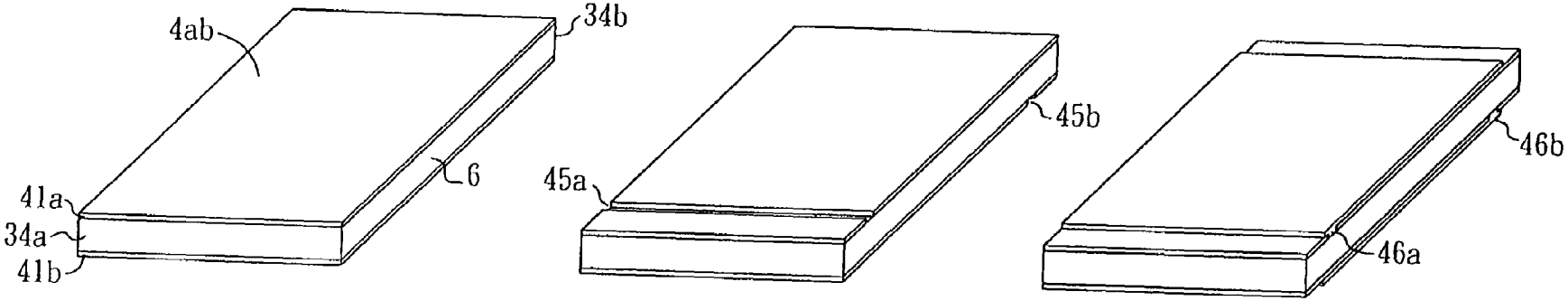
Fig. 7A
Fig. 7B
Fig. 7C
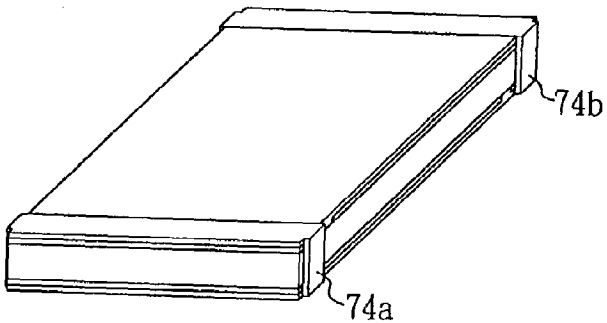
Fig. 7D
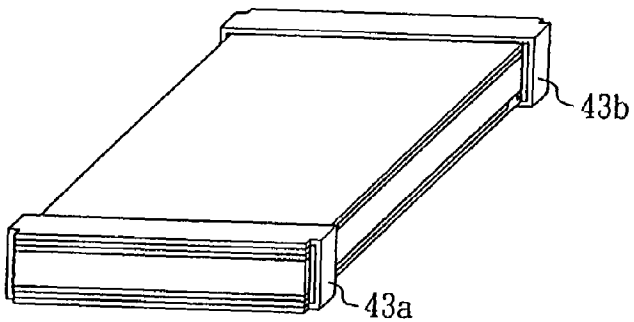
Fig. 7E

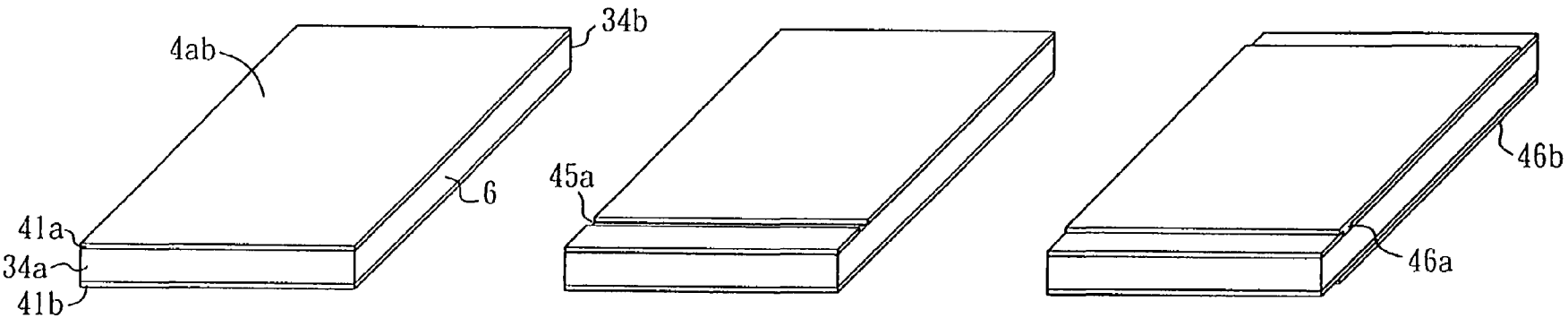
Fig. 8C
Fig. 8B
Fig. 8A
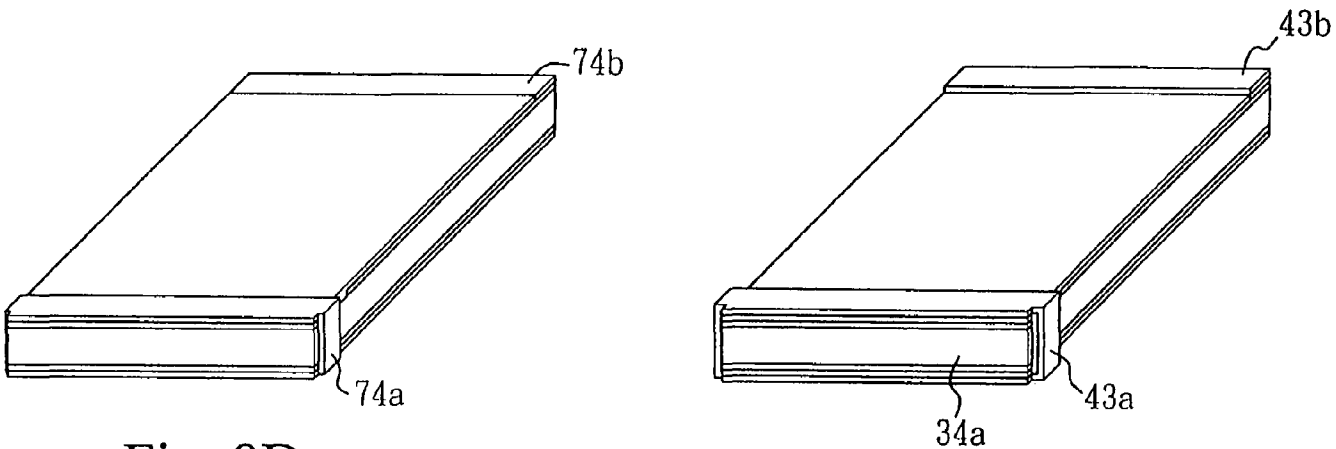
Fig. 8E
Fig. 8D

RESETABLE OVER-CURRENT PROTECTION DEVICE AND METHOD OF MAKING THE SAME

CROSS-REFERENCES TO RELATED APPLICATIONS

Not Applicable

STATEMENT REGARDING FEDERALLY SPONSORED RESEARCH OR DEVELOPMENT

Not Applicable

DESCRIPTION

1. Field of Invention

The present invention relates to a resetable over-current protection device, particularly one where disconnected areas are maintained at end faces of formed cutting regions of the protection device, wherein the end faces of the formed cutting regions are partly formed with electrically conductive layers so as to increase the lifespan of the device, to enhance flexibility in manufacturing and to reduce consumption of materials.

2. Background of Invention

Resetable over-current protection devices are characterized by their capability to automatically reset to their original state of low resistance after current switching-off caused by over-current actuations. In other words, the devices may be actuated or operated repetitively. Such devices have been widely implemented in circuits for various kinds of electronic products.

A resetable over-current protection device is mainly composed of polymer materials that expand upon heating to serve as means for switching off currents. The thermal expansion coefficients of polymer materials are far greater than those of metal materials for forming conventional electrodes. The repetitive actuations of a resetable over-current protection device will result in stress to be accumulated at the electrode connection structure of the resetable over-current protection device, which would greatly affect the lifespan of the resetable over-current protection device. To meet the design demands, many electrode connection structures have been implemented in the currently available resetable over-current protection devices made by corresponding manufacturing processes that accommodate the electrode structures.

In view of the problems found in electrode connection structure of commercially available resetable over-current protection devices, the present invention discloses an electrode connection structure of resetable over-current protection device, as a solution that provides maximum actuation cycles within the lifespan of the resetable over-current protection device and that allows easy manufacturing and reduces and consumption of material.

FIGS. 1A–1C illustrate the first example for a conventional resetable over-current protection device. The device adopts the common through-hole process for making a PCB to form a plurality of through holes 10 in each of the neighboring components 4*ab* on a device sheet 1. A first and a second electrode connections 12, 13 are then formed at each of the through holes 10, for connecting a top and a bottom laminar electrodes 11*a* and 11*b* of the protection device, respectively, as shown in FIGS. 1B and 1C. The primary device sheet 1 is then divided into a plurality of final device components 4*ab* along the incision lines 14*x*, 14*y* formed on the sheet exterior, as shown in FIG. 1B.

In such prior art, the proportion of wasted material is kept to minimal because all components 4*ab* on the primary device sheet 1 neighbor each other. After fabrication, other than the relative small regions of the through holes 10, sides 14*z* of polymer material 6 are not surrounded by the top and bottom laminar electrodes 11*a*, 11*b* nor the second electrode connections 13. As such, a sufficient space is provided for the enclosed polymer to release stress upon thermal expansion. Such through-hole type electrodes can generally meet the required cycles of repetitive actuations within the lifespan of resetable over-current protection devices unless they have been subjected to damages in subsequent manufacturing processes, since stringent requirements for structural strength are not applied thereto. The problems encountered by such prior art reside in the difficulty of preventing from damaging the electrode connections 12, 13 prior to formation of the final over-current protection devices.

As shown in FIGS. 1A and 1B, there are less restrictions in cutting along the incision lines 14*y* extending along the Y-axis because the incision lines 14*y* do not pass through the first and second electrode connections 12, 13, such that many cutting mechanisms may be adopted, such as a punching die, a cutting tool or a rotary tool, to perform the cutting operation. However, there are more restrictions in cutting along the incisions lines 14*x* extending along the X-axis in FIG. 1B because the incision lines 14*x* pass through the first and second electrode connections 12, 13, such that the punching die or cutting tool may cause damages to the first and second electrode connections having smaller dimensions due to mechanical stress, thereby reducing strength of the first and second electrode connections and affecting the maximum cycles of repetitive actuations within the lifespan of the resetable over-current protection devices. Hence, a diamond cutting apparatus in the form of rotary tool becomes the only choice in making the resetable over-current protection devices. Such a process not only involves the problem of poor operability, but also significant consumption of pure water. To summarize the problems of cutting along the X and Y-axes, if different processes are used to cut along the incision lines 14*x* and 14*y*, the fabrication line needs to be designed to accommodate the different processes; if, on the other hand, the same process is used along the incision lines 14*x* and 14*y*, the diamond cutting apparatus is the only choice to be used in the fabrication line, which results in much higher consumption of pure water.

FIGS. 2A–2D illustrate the electrode connection structure in the second example for a conventional resetable over-current protection device. The device adopts the common die punching process to form a plurality of through slots 20 in a primary device sheet 2, as shown in FIG. 2A, wherein the primary device sheet 2 is then divided into a plurality of strips. The through-hole process commonly adopted in PCB fabrication is then adopted to form left electrode connections 22*a*, 23*a* and right electrode connections 22*b*, 23*b* for connecting a top laminar electrode 21*a* and a bottom laminar electrode 21*b* on individual pieces of strips, as shown in FIGS. 2B to 2D. The top laminar electrode 21*a* and the bottom laminar electrode 21*b* are, respectively, formed thereover with a top insulation layer 22*c* and a bottom insulation layer 22*d*. The primary device sheet 2 is then divided into a plurality of final device components 5*ab* along the incision lines 24*y* formed on the exteriors of the strips, as shown in FIG. 2B. FIG. 2B illustrates one of the final device components 5*ab*. Portions of the device component

5*ab* in FIG. 2B, that are proximate to the left and right end faces 25*a*, 25*b*, are completely enclosed by the left electrode connections 23*a* and the right electrode connections 23*b*, as shown in FIG. 2C. The left electrode connections 22*a* and right electrode connections 22*b* jointly form a first pair of substantially symmetrical electrodes 22, while the left electrode connections 23*a* and the right electrode connections jointly form a second pair of substantially symmetrical electrodes 23.

The complete enclosed structure at the end faces 25*a*, 25*b* that must be connected, in the electrode structures in the second example of prior art, provides an enhanced connection as compared to the first example of prior art. In addition, the enlarged connection area allows the use of the punching dies or cutting tools that have improved operability and lower resource consumption, to perform cutting operation along the incision lines 24*y* extending along the Y-axis in FIG. 2B during formation of the final over-current protection devices. However, problems are still found in such prior art, including:

1. The wasted materials that have been removed by the punching die to form the through slots on the primary device sheet 2 result in a relatively low quantity of device components within a fixed area of primary device sheet.

2. The space for the polymer to release stress upon thermal expansion is reduced by the complete enclosure of the polymer by the electrode connections (22*a*, 22*b*, 23*a*, 23*b*), such that requirements for structural strength of such through-slot electrodes must be more stringent as compared to those for the first example of prior art.

3. During formation of the final over-current protection devices 5*ab* by cutting along the incision lines 24*y* extending along the Y-axis, use of the punching dies or cutting tools may still cause damages to end faces of the electrode structures, unless the electrode structures or the electrode layers are of a sufficient thickness.

4. During formation of the final over-current protection devices 5*ab* by cutting along the incision lines 24*y* extending along the Y-axis, use of the diamond cutting apparatus will need to face the problem of poor operability and consumption of pure water in exchange for lowering strength requirements for the electrode structures.

SUMMARY OF INVENTION

In view of the problems found in the conventional electrode connection structures of resetable over-current protection devices, the present invention discloses an electrode connection structure of resetable over-current protection device, as a solution that provides maximum actuation cycles within the lifespan of the resetable over-current protection device and that allows easy manufacturing and reduces and consumption of material.

It is a primary objective of this invention is to fully utilize a primary sheet in the first step of manufacturing the electrode connection structure of resetable over-current protection device of the present invention.

It is a further objective of this invention to provide an electrode connection structure of resetable over-current protection device, wherein the electrode connection structure only occupies a small portion of area at end faces of each component to keep a maximum space for thermal expansion of the polymer material, so as to lower the strength requirements for the electrode connection structure.

It is another objective of this invention to provide an electrode connection structure of resetable over-current protection device, where the locations of cutting operations are designed to dodge away from end faces formed by the incision lines, so as to allow easy operation, to reduce resource consumption, and to ensure that subsequent manufacturing processes do not cause damages to the electrode connection structure.

To achieve the above objectives, according to the first aspect of a resetable over-current protection device of the present invention, the resetable over-current protection device includes:

a resistance variable material, having: a top surface, a bottom surface, a left end face, and a right end face;

a top laminar electrode disposed above the top surface, the top laminar electrode having a top trench for exposing a part of the material;

a bottom laminar electrode disposed above the bottom surface;

a top insulation layer covering a part of the top laminar electrode and the top trench;

a bottom insulation layer covering a part of the bottom laminar electrode;

a first left connection layer, covering a part of the left end face of the material, and the top laminar electrode and bottom laminar electrode proximate to the left end face, for electrically connecting the top laminar electrode and the bottom laminar electrode;

a first right connection, covering the top laminar electrode proximate to the right end face;

a second left connection layer, covering the first left connection layer to serve as a first contact point; and a second right connection, covering the first right connection to serve as a second contact point, wherein the first left connection layer preferably covers 15 to 95% of an entire area of the left end face of the material, better preferably 30 to 80%, and best preferably 35 to 50%.

According to the second aspect of a resetable over-current protection device of the present invention, the resetable over-current protection device includes:

a resistance variable material, having: a top surface, a bottom surface, a left end face and a right end face;

a top laminar electrode disposed above the top surface, the top laminar electrode having a top trench for exposing a part of the material;

a bottom laminar electrode disposed above the bottom surface, the bottom laminar electrode having a bottom trench for exposing a part of the material;

a top insulation layer covering a part of the top laminar electrode and the top trench;

a bottom insulation layer covering a part of the bottom laminar electrode and the bottom trench;

a first left connection layer, covering a part of the left end face of the material, and the top laminar electrode and bottom laminar electrode proximate to the left end face, for electrically connecting the top laminar electrode and the bottom laminar electrode;

a first right connection, covering a part of the right end face of the material, and the top laminar electrode and bottom laminar electrode proximate to the right end face, for electrically connecting the top laminar electrode and the bottom laminar electrode;

a second left connection layer, covering the first left connection layer to serve as a first contact point; and a second right connection, covering the first right connection to serve as a second contact point, wherein the first left connection layer preferably covers 15 to 95% of an entire area of the left end face of the material, better preferably 30 to 80%, and best preferably 35 to 50%; and wherein the first right connection layer preferably covers 15 to 95% of an entire area of the right end face of the material, better preferably 30 to 80%, and best preferably 35 to 50%.

According to the third aspect of a resetable over-current protection device of the present invention, the resetable over-current protection device includes:

a resistance variable material, having: a top surface, a bottom surface, a left end face, and a right end face;

a top laminar electrode disposed above the top surface, the top laminar electrode having a top trench for exposing a part of the material;

a bottom laminar electrode disposed above the bottom surface;

a top insulation layer covering a part of the top laminar electrode and the top trench;

a bottom insulation layer covering a part of the bottom laminar electrode;

a first left connection layer, covering the top laminar electrode and the bottom laminar electrode proximate to the left end face, and the material proximate to the left end face and the right end face, for electrically connecting the top laminar electrode and the bottom laminar electrode;

a first right connection, covering the top laminar electrode proximate to the right end face;

a second left connection layer, covering the first left connection layer to serve as a first contact point; and a second right connection, covering the first right connection to serve as a second contact point.

According to the fourth aspect of a resetable over-current protection device of the present invention, the resetable over-current protection device includes:

a resistance variable material, having: a top surface, a bottom surface, a left end face, and a right end face;

a top laminar electrode disposed above the top surface, the top laminar electrode having a top trench for exposing a part of the material;

a bottom laminar electrode disposed above the bottom surface, the bottom laminar electrode having a bottom trench for exposing a part of the material;

a top insulation layer covering a part of the top laminar electrode and the top trench;

a bottom insulation layer covering a part of the bottom laminar electrode and the bottom trench;

a first left connection layer, covering the top laminar electrode and the bottom laminar electrode proximate to the left end face, and the material proximate to the left end face and the right end face, for electrically connecting the top laminar electrode and the bottom laminar electrode;

a first right connection layer, covering the top laminar electrode and the bottom laminar electrode proximate to the right end face, and the material proximate to the left end face and the right end face, for electrically connecting the top laminar electrode and the bottom laminar electrode;

a second left connection layer, covering the first left connection layer to serve as a first contact point; and a second right connection, covering the first right connection to serve as a second contact point.

It is yet another objective of the present invention to provide a method for manufacturing resetable over-current protection devices to fully utilize the primary sheet.

To achieve the above objective, according to the first aspect of a method for manufacturing resetable over-current protection devices of the present invention, the method includes the steps of:

(a) providing a resistance variable sheet having a top laminar electrode and a bottom laminar electrode;

(b) cutting the sheet into a plurality of strips, each strip having: a top surface, a bottom surface, a left end face and a right end face;

(c) removing a part of the top laminar electrode of each of the strips along a longitudinal direction of the sheet to form a top trench, for exposing a part of the sheet;

(d) covering a part of the top laminar electrode and the top trench with a top insulation layer;

(e) covering a part of the bottom laminar electrode with a bottom insulation layer;

(f) covering each of the top laminar electrode and the bottom laminar electrode proximate to the left end face, and a part of the left end of each of the strips with first left connection layers, for electrically connecting the top laminar electrode and the bottom laminar electrode;

(g) covering the top laminar electrode proximate to the right end face with a first right connection;

(h) covering each of the first left connection layers with second left connection layers serving as a first contact point;

(i) covering the first right connection with a second right connection serving as a second contact point; and (j) cutting each of the strips to form a plurality of resetable over-current protection devices.

To achieve the above objective, according to the second aspect of a method for manufacturing resetable over-current protection devices of the present invention, the method includes the steps of:

(a) providing a resistance variable sheet having a top laminar electrode and a bottom laminar electrode;

(b) cutting the sheet into a plurality of strips, each strip having: a top surface, a bottom surface, a left end face and a right end face;

(c) removing a part of the top laminar electrode of each of the strips along a longitudinal direction of the sheet to form a top trench, for exposing a part of the sheet;

(d) removing a part of the bottom laminar electrode of each of the strips along a longitudinal direction of the sheet to form a bottom trench, for exposing a part of the sheet;

(e) covering a part of the top laminar electrode and the top trench with a top insulation layer;

(f) covering a part of the bottom laminar electrode with a bottom insulation layer and the bottom trench;

(g) covering each of the top laminar electrode and the bottom laminar electrode proximate to the left end face, and a part of the left end of each of the strips with first left connection layers, for electrically connecting the top laminar electrode and the bottom laminar electrode;

(h) covering each of the top laminar electrode and the bottom laminar electrode proximate to the right end face, and a part of the right end of each of the strips with first right connection layers, for electrically connecting the top laminar electrode and the bottom laminar electrode;

(i) covering each of the first left connection layers with second left connection layers serving as a first contact point;

(j) covering each of the first right connections with second right connections serving as a second contact point; and (k) cutting each of the strips to form a plurality of resetable over-current protection devices.

To achieve the above objective, according to the third aspect of a method for manufacturing resetable over-current protection devices of the present invention, the method includes the steps of:

(a) providing a resistance variable sheet having a top laminar electrode and a bottom laminar electrode;

(b) cutting the sheet into a plurality of strips, each strip having: a top surface, a bottom surface, a left end face and a right end face;

(c) removing a part of the top laminar electrode of each of the strips along a transverse direction of the sheet to form a plurality of top trenches, for exposing a part of the sheet;

(d) covering a part of the top laminar electrode and the top trench with a top insulation layer;

(e) covering a part of the bottom laminar electrode with a bottom insulation layer;

(f) covering each of the top laminar electrode, the bottom laminar electrode, the left end face and the right end face with first left connection layers to form a plurality of looped connection layers, for electrically connecting the top laminar electrode and the bottom laminar electrode;

(g) covering each of the first left connection layers with second left connection layers serving as a contact point; and (j) cutting each of the strips to form a plurality of resetable over-current protection devices.

To achieve the above objective, according to the fourth aspect of a method for manufacturing resetable over-current protection devices of the present invention, the method includes the steps of:

(a) providing a resistance variable sheet having a top laminar electrode and a bottom laminar electrode;

(b) cutting the sheet into a plurality of strips, each strip having: a top surface, a bottom surface, a left end face and a right end face;

(c) removing a part of the top laminar electrode of each of the strips along a transverse direction of the sheet to form a plurality of top trenches, for exposing a part of the sheet;

(d) removing a part of the bottom laminar electrode of each of the strips along a transverse direction of the sheet to form a plurality of bottom trenches, for exposing a part of the sheet;

(e) covering a part of the top laminar electrode and the top trench with a top insulation layer;

(f) covering a part of the bottom laminar electrode with a bottom insulation layer and the bottom trenches;

(g) covering each of the top laminar electrode, the bottom laminar electrode, the left end face and the right end face with first left connection layers to form a plurality of looped connection layers, for electrically connecting the top laminar electrode and the bottom laminar electrode;

(h) covering each of the top laminar electrode, the bottom laminar electrode, the left end face and the right end face of each of the strips with first right connection layers, whereby each of the first right connections electrically connects the top laminar electrode and the bottom laminar electrode;

(i) covering each of the first left connection layers with second left connection layers serving as a first contact point;

(j) covering each of the first right connections with second right connections serving as a second contact point; and (k) cutting each of the strips to form a plurality of resetable over-current protection devices.

These and other modifications and advantages will become even more apparent from the following detained description of a preferred embodiment of the invention and from the drawings in which:

BRIEF DESCRIPTION OF THE DRAWINGS

FIGS. 1A–1C are schematic views illustrating the first example for a conventional resetable over-current protection device containing an electrode connection fabricated from circular through-holes, wherein FIG. 1B is an enlarged plan view of a device containing a circular through hole within FIG. 1A and FIG. 1C is a cross-sectional view showing a cross-sectional view of the device in FIG. 1B;

FIGS. 7A–7E are schematic views illustrating a first method of manufacturing the various components constructing the electrode connection structure of resetable over-current protection device in FIGS. 4A–4E.

FIGS. 8A–8E are schematic views illustrating a second method of manufacturing the various components constructing the electrode connection structure of resetable over-current protection device in FIGS. 4A–4E.

DETAILED DESCRIPTION OF THE INVENTION (PREFERRED EMBODIMENTS)

The present invention discloses an electrode connection structure of resetable over-current protection device and method of making the same, as those illustrated in FIGS. 3A–3E to 8A–8E.

Figure 1A:
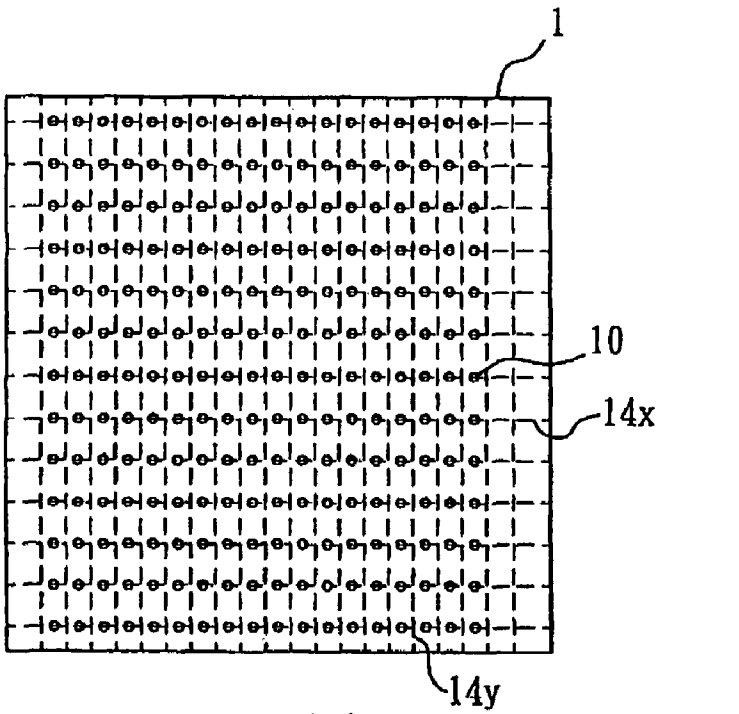
Fig. 1A PRIOR ART
Figure 1B:
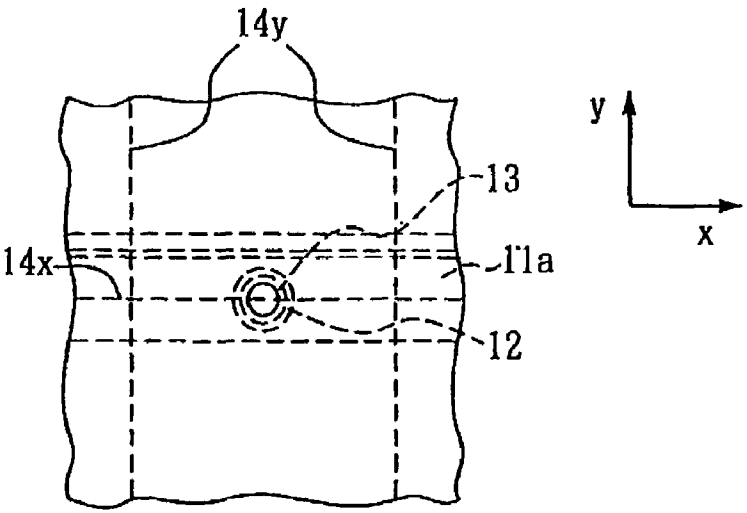
Fig. 1B PRIOR ART
Figure 1C:
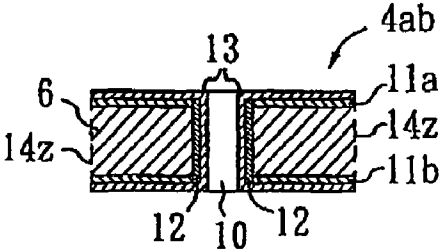
Fig. 1C PRIOR ART
Figure 2D:
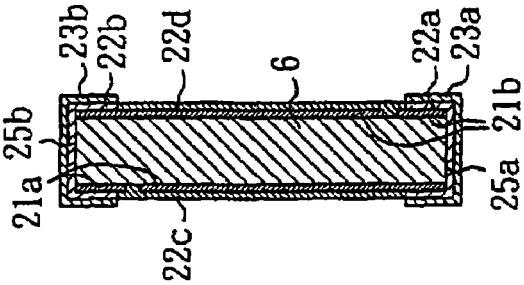
Fig. 2D PRIOR ART
FIGS. 2A–2D are schematic views illustrating the second example for a conventional resetable over-current protection device an electrode connection fabricated from through-slots.
Figure 2B:
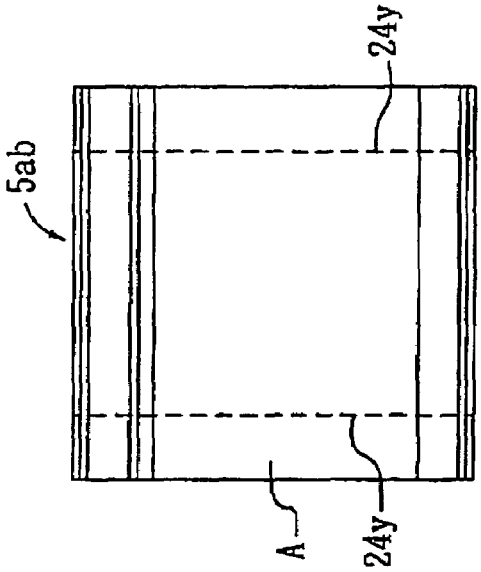
Figure 2C:
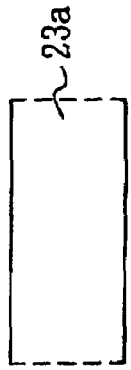
Fig. 2C PRIOR ART
Figure 2A:
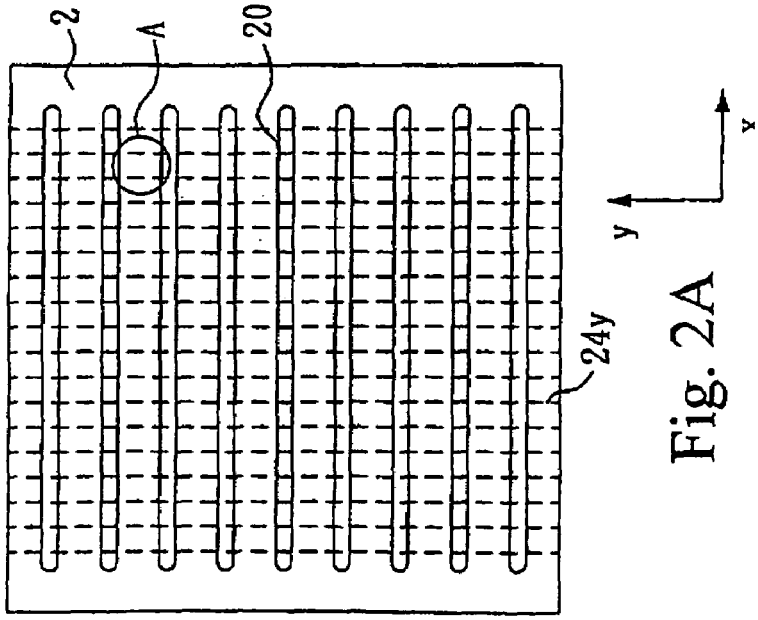
Fig. 2A PRIOR ART
Figure 3B:
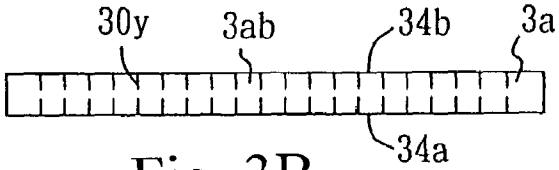
FIGS. 3A–3E are schematic views illustrating the electrode connection structure of resetable over-current protection device according to a first embodiment of the present invention.
Figure 3E:
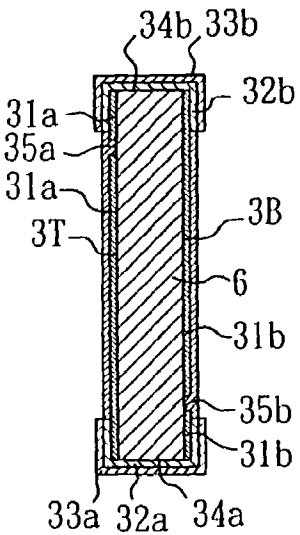
Figure 3C:
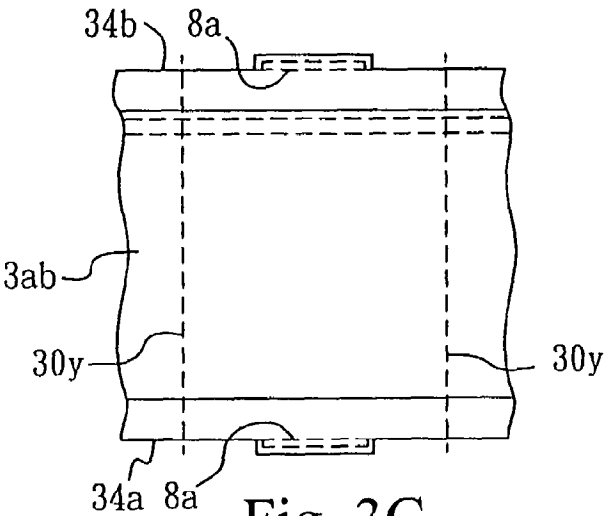
Figure 3D:
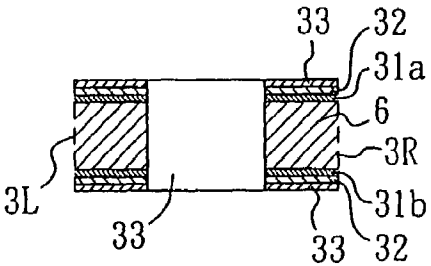
Figure 3A:
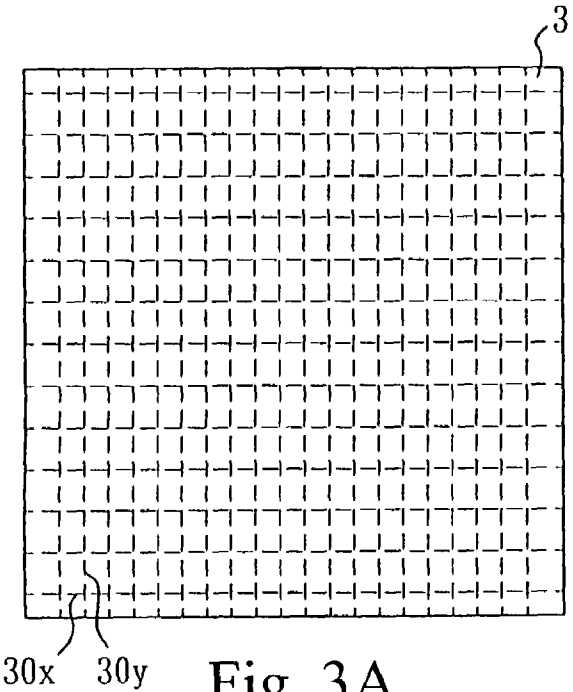

FIGS. 3A–3E illustrate the electrode connection structure of resetable over-current protection device according to a first embodiment of the present invention. A primary device sheet 3 in FIG. 3A is first punched or cut into a plurality of strips 3*a*, as shown in FIG. 3B, along the incision lines 30*x* formed on the sheet exterior and extending along the X-axis. The strips are then divided into a plurality of device components 3*ab* along the incision lines 30*y* formed on the sheet exterior and extending along the Y-axis. Each of the components 3*ab* exhibits a cubic configuration, including a top surface 3T, a bottom surface 3B, a left surface 3L, a right side surface 3R, a left end face 34*b* and a right end face 34*b*. As shown in FIGS. 3C–3E, the two end faces 34*a*, 34*b* and two central regions 8*a* of each of the device components 34*b* are, respectively, formed thereon with a first pair of connection layers 32 and a second pair of connection layers 33 for connecting a top and a bottom laminar electrode 31*a* and 32*b* of the resetable over-current protection devices. The first pair of connection layers 32 is dimensioned to cover 15 to 95% of an entire area of the two end faces 34*a*, 34*b* of each of the device components 3*ab*, better preferably 30 to 80%, and best preferably 35 to 50%. As shown in FIG. 3E, the top and bottom laminar electrode 31*a*, 31*b* each include a top trench 35*a* and a bottom trench 35*b*. Though FIG. 3D illustrates one pair of first connection layers 32 and one pair of second connection layers 33, the left end face 34*a* and right end face 34*b* of each strip 3*a* are formed thereon with a plurality of equally-spaced first pairs of connection layers 32 and second pairs of connection layers 33. The first pairs of connection layers 32 each include a first left connection layer 32*a* and a first right connection 32*b*. The first left connection layer 32*a* electrically connects the top and bottom laminar electrodes 31*a* and 31*b*. The second pairs of connection layers 33 each include a second left connection layer 33*a* and a second right connection 33*b*. The second left connection layer 33*a* serves as a contact point to be connected to other electrical devices. The second right connection 33*b* also serves as a contact point to be connected to other electrical devices. Because the connection layers 32, 33 are designed to dodge away from end faces formed by the incision lines 30*y*, the strips 3*a* having the above-mentioned electrode connection structure may be directly punched or cut into a plurality of device components 3*ab* along the incision lines 30*y* without damaging connection layers.

According to a second embodiment of the resetable over-current protection device of the present invention, symmetrical connection layers 32, 33 are not required in a final resetable over-current protection device. In other words, the first right connection 32*b* does not necessarily cover the right end face 34*b* or the bottom laminar electrode 31*b*, but only the top laminar electrode 31*a*, while the second right connection 33*b* only covers first right connection 32*b*. In addition, the bottom laminar electrode 31*b* is not necessarily formed with a bottom trench 35*b*.

Figure 4E:
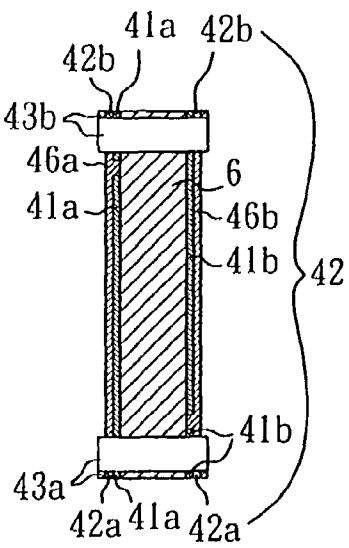
FIGS. 4A–4E are schematic views illustrating the electrode connection structure of resetable over-current protection device according to a further embodiment of the present invention.
Figure 4C:
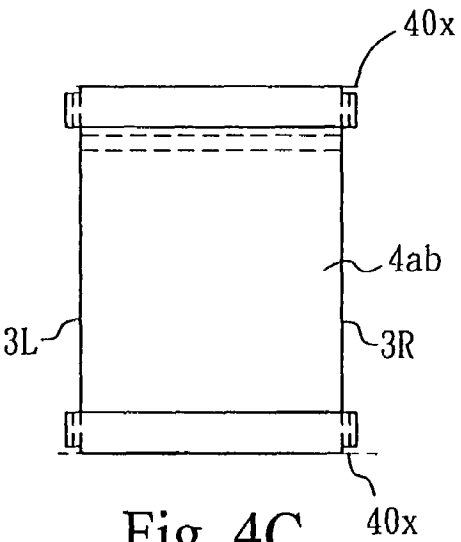
Figure 4D:
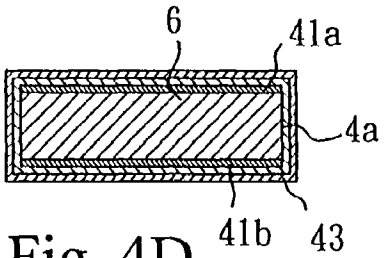
Figure 4B:
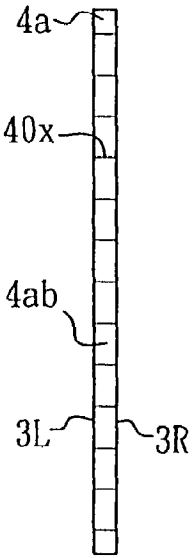
Figure 4A:
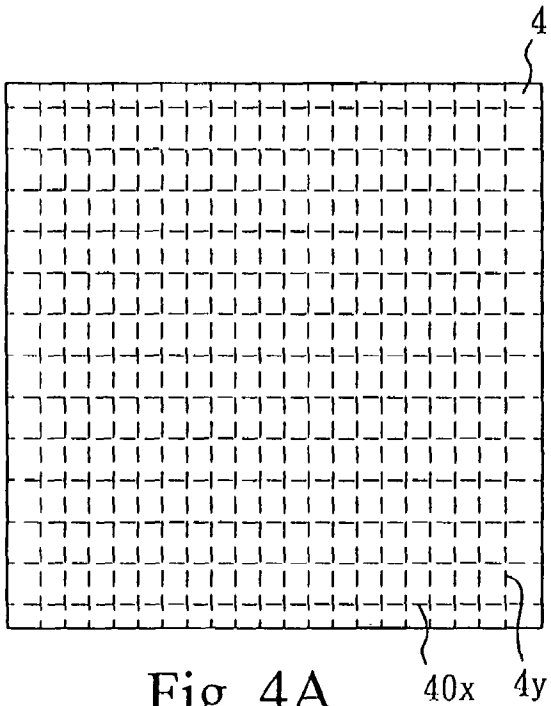

FIGS. 4A–4E illustrate the electrode connection structure of resetable over-current protection device according to a third embodiment of the present invention. A primary device sheet 4 in FIG. 4A is first punched or cut into a plurality of strips 4*a*, as shown in FIG. 4B, along the incision lines 40*y* formed on the sheet exterior and extending along the Y-axis (longitudinal direction). The strips are then divided into a plurality of device components 4*ab* along the incision lines 40*x* formed on the sheet exterior and extending along the X-axis (traverse direction). As shown in FIGS. 4C–4E, the top surface 3T and bottom surface 3B of each of the device components 4*ab* are, respectively, formed thereon with a top laminar electrode 41*a* and a bottom laminar electrode 41*b* for connecting the resetable over-current protection device. A first pair and a second pair of connection layers 42, 43 are in turn formed on the top and bottom surfaces 3T, 3B and the two side surfaces 3L, 3R proximate to the right and left end faces. The first pair of connection layers 42 includes a first left connection layer 42*a* and a first right connection 42*b*. The second pair of connection layers 43 includes a second left connection layer 43*a* and a second right connection 43*b*. Because the first pair of connection layers 42 and the second pair of connection layers 43 are designed to dodge away from end faces formed by the incision lines 40*x*, the strips 4*a* having the above-mentioned electrode connection structure may be directly punched or cut into a plurality of device components 4*ab* along the incision lines without damaging electrode connection structures.

According to a fourth embodiment of the resetable over-current protection device of the present invention, symmetrical connection layers 42, 43 are not required in a final resetable over-current protection device. In other words, the first right connection 42*b* only cover the top laminar electrode 41*a*, while the second right connection 43*b* only covers first right connection 42*b*. In addition, the bottom laminar electrode 41*b* is not necessarily formed with a bottom trench 45*b*.

Figure 5C:
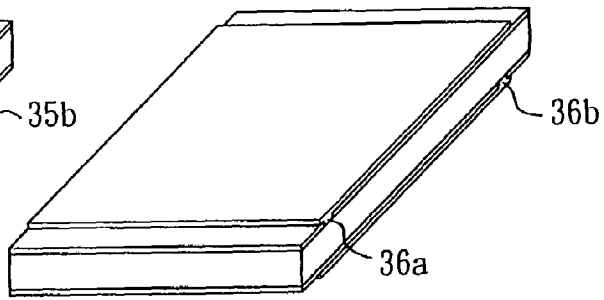
FIGS. 5A–5E are schematic views illustrating a first method of manufacturing the various components constructing the electrode connection structure of resetable over-current protection device in FIGS. 3A–3E.
Figure 5B:
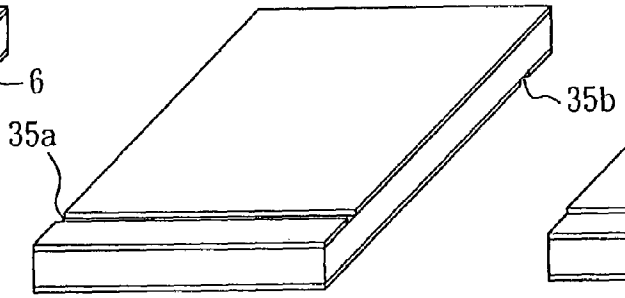
Figure 5A:
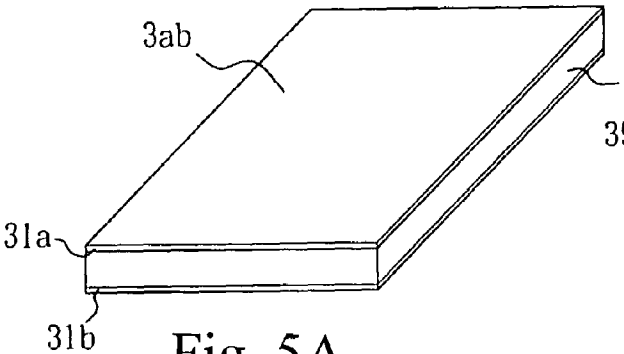

FIGS. 5A–5E illustrate a first method of manufacturing the electrode connection structure of resetable over-current protection device shown in FIGS. 3A–3E. FIG. 5A illustrates a device component 3*ab* having a top laminar electrode 31*a* and a bottom laminar electrode 31*b*, that is divided from a sheet 3.

Figure 5E:
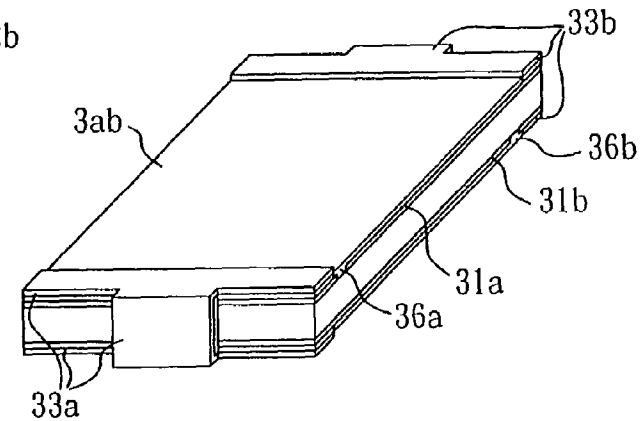
Figure 5D:
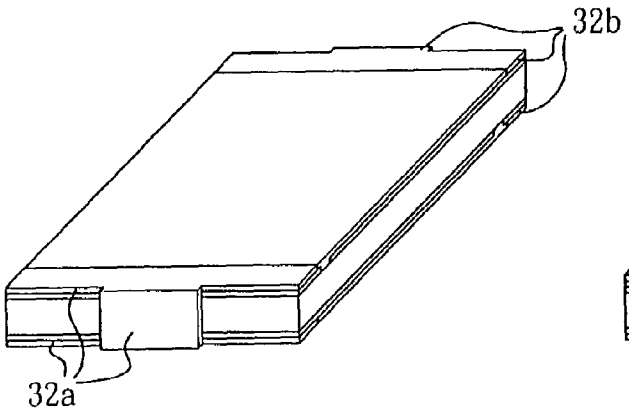
Figure 6C:
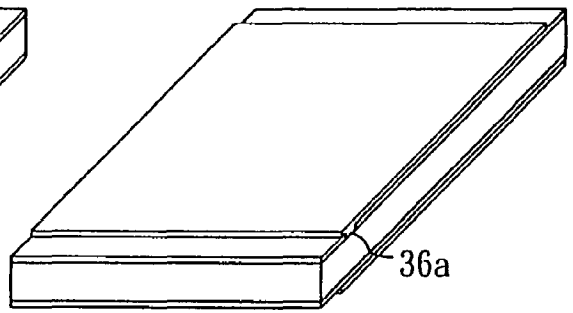
FIGS. 6A–6E are schematic views illustrating a second method of manufacturing the various components constructing the electrode connection structure of resetable over-current protection device in FIGS. 3A–3E.
Figure 6B:
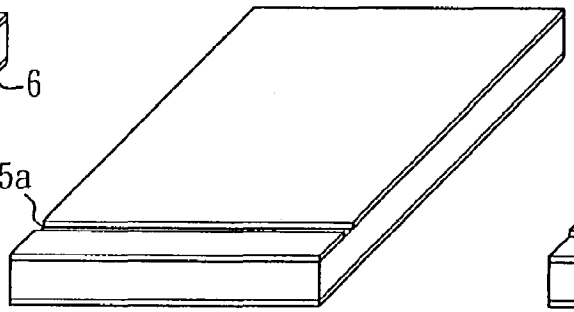
Figure 6A:
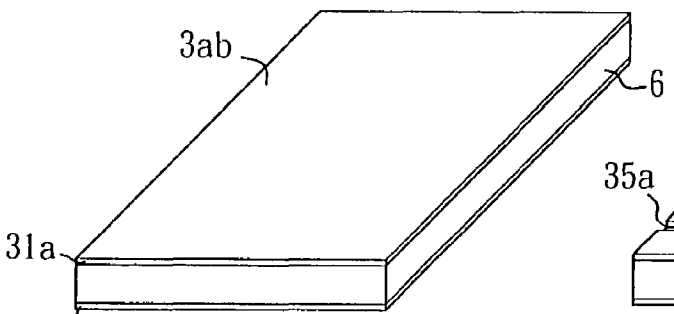
Figure 6D:
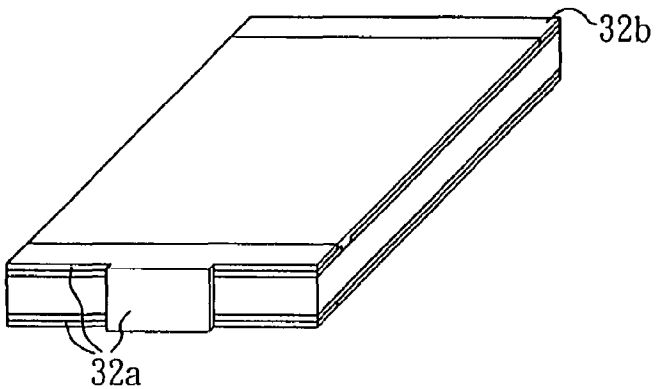
Figure 6E:
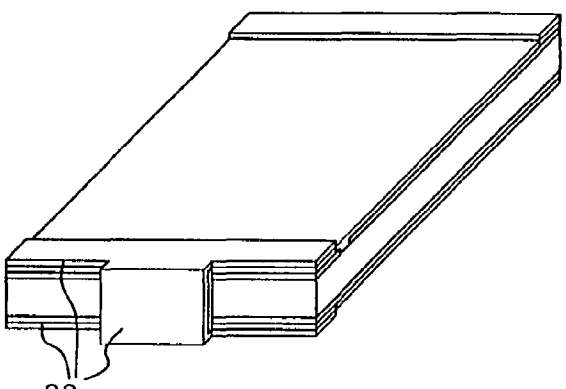

FIG. 5B illustrates that the top laminar electrode 31*a* is formed thereon with a top trench 35*a*, and that the bottom laminar electrode 31*b* is formed thereon with a bottom trench 35*b*. FIG. 5C illustrates formation of a top insulation layer 36*a* and a bottom insulation layer 36*b*. FIG. 5D illustrates formation of a first left connection layer 32*a* and a first right connection 32*b* over a part of each of the left end face 34*a* and right end face 34*b*, and above the top lammar electrode 31*a* and bottom laminar electrode 31*b* proximate to the end faces. FIG. 5E illustrates formation of a second left connection layer 33*a* and a second right connection 33*b* over each of the first left connection layer 32*a* and first right connection 32*b*.

FIGS. 6A–6E illustrate a second method of manufacturing the electrode connection structure of resetable over-current protection device shown in FIGS. 3A–3E. Differing from the device component 3*ab* of FIGS. 5A–5E where the connection layers 32, 33 are provided at the two end faces 34*a*, 34*b*, the device component 3*ab* in FIGS. 6A–6E is provided with connection layers 32*a*, 32*b* at one end face 34*a*, and the bottom laminar electrode 31*b* is not formed with a bottom trench 35*b*. The remaining structures are the same as the embodiment illustrated in FIGS. 5A–5E and not repeated herein.

FIGS. 7A–7E illustrate a first method of manufacturing the electrode connection structure of resetable over-current protection device shown in FIGS. 4A–4E. FIG. 7A illustrates a device component 4*ab* that is divided from a sheet 4, wherein the device component 4*a* is covered with a top laminar electrode 41*a* and a bottom laminar electrode 41*b*. With reference to FIG. 7B, the top laminar electrode 41*a* is formed therein with a top trench 45*a*, and the bottom laminar electrode 41*b* is formed therein with a bottom trench 45*b*. As shown in FIG. 7C, the top laminar electrode 41*a* is formed thereover with a top insulation layer 46*a*, and the bottom laminar electrode 41*b* is formed thereover with a bottom insulation layer 46*b*. The top insulation layer 46*a* passes through the top trench 45*a* to contact the polymer material 6 disposed between the laminar electrodes 41*a* and 41*b*. The top insulation layer 46*a* and bottom insulation layer 46*b* do not cover top laminar electrode 41*a* and bottom laminar electrode 41*b* proximate to the end faces 34*a*, 34*b* of the component 4*ab*. As shown in FIG. 7D, the component 4*ab* proximate to the end faces 34*a*, 34*b* components 4*ab* is covered by a looped first left connection layer 74*a* and a looped first right connection 74*b*. As shown in FIG. 7E, the first left connection layer 74*a* and first right connection 74*b* are, respectively, covered by a second left connection layer 43*a* and a second right connection 43*b*.

FIGS. 8A–8E illustrate a second method of manufacturing the electrode connection structure of resetable over-current protection device shown in FIGS. 4A–4E. Differing from the device component 4*ab* of FIGS. 7A–7E, the device component 4*ab* in FIGS. 8A–8E is provided with the looped first left connection layer 74*a* and second left connection layer 43*a* proximate to one end face 34*a* of the component, and only the top laminar electrode 41*a* proximate to another end face 34*b* of the component 4*ab* is covered with the first right connection 74*b* and second right connection 43*b*, without the provision of the bottom trench 46*b*.

The above embodiments for the electrode connection structure disclose a two-layer electrode structure, while modifications may be made to obtain a structure having more than two layers.

The following effects may be easily observed from the embodiments for the resetable over-current protection devices illustrated in FIGS. 3A–3E to FIGS. 8A–8E according to the present invention:

1. The waste of material is reduced to a minimum because it is not necessary to drill circular through holes or elongated through slots into the primary sheet to ensure full utilization of the primary sheet.

2. The area occupied by the electrode connections is minimized to provide a maximum area for expansion of the polymer material, such that lowering of strength requirements for the electrode structure becomes possible.

3. The electrode connections of each component unit are designed to dodge away from the end faces formed by the incision lines, to allow easy operation, to reduce resource consumption, and to ensure that subsequent manufacturing processes do not cause damages to the electrode connection structure.

This invention is related to a novel creation that makes a breakthrough in the art. Aforementioned explanations, however, are directed to the description of preferred embodiments according to this invention. Since this invention is not limited to the specific details described in connection with the preferred embodiments, changes and implementations to certain features of the preferred embodiments without altering the overall basic function of the invention are contemplated within the scope of the appended claims.

What is claimed is:

1. A resetable over-current protection device, comprising:

a resistance variable material having a top surface, a bottom surface, a left end face, and a right end face;

a top laminar electrode disposed on the top surface, the top laminar electrode having a top trench for exposing a part of the material;

a bottom laminar electrode disposed on the bottom surface;

a top insulation layer covering a part of the top laminar electrode and the top trench;

a bottom insulation layer covering a part of the bottom laminar electrode;

a first left connection layer, covering a part of the left end face of the material, and the top laminar electrode and bottom laminar electrode proximate to the left end face, for electrically connecting the top laminar electrode and the bottom laminar electrode;

a first right connection, covering the top laminar electrode proximate to the right end face;

a second left connection layer, covering the first left connection layer to serve as a first contact point; and a second right connection, covering the first right connection to serve as a second contact point.

2. The device according to claim 1, wherein the first left connection layer covers 15 to 95% of an entire area of the left end face of the material.

3. The device according to claim 1, wherein the first left connection layer covers 30 to 80% of an entire area of the left end face of the material.

4. The device according to claim 1, wherein the first left connection layer covers 35 to 50% of an entire area of the left end face of the material.

5. A method for manufacturing the resetable over-current protection devices of claim 1, comprising the steps of:

(a) providing a resistance variable sheet having a top laminar electrode and a bottom laminar electrode;

(b) cutting the sheet into a plurality of strips, each strip having: a top surface, a bottom surface, a left end face and a right end face;

(c) removing a part of the top laminar electrode of each of the strips along a longitudinal direction of the sheet to form a top trench, for exposing a part of the sheet;

(d) covering a part of the top laminar electrode and the top trench with a top insulation layer;

(e) covering a part of the bottom laminar electrode with a bottom insulation layer;

(f) covering each of the top laminar electrode and the bottom laminar electrode proximate to the left end face, and a part of the left end of each of the strips with first left connection layers, for electrically connecting the top laminar electrode and the bottom laminar electrode;

(g) covering the top laminar electrode proximate to the right end face with a first right connection;

(h) covering each of the first left connection layers with second left connection layers serving as a first contact point;

(i) covering the first right connection with a second right connection serving as a second contact point; and (j) cutting each of the strips to form a plurality of resetable over-current protection devices.

6. A resetable over-current protection device, comprising:

a resistance variable material having a top surface, a bottom surface, a left end face and a right end face;

a top laminar electrode disposed on the top surface, the top laminar electrode having a top trench for exposing a part of the material;

a bottom laminar electrode disposed on the bottom surface, the bottom laminar electrode having a bottom trench for exposing a part of the material;

a top insulation layer covering a part of the top laminar electrode and the top trench;

a bottom insulation layer covering a part of the bottom laminar electrode and the bottom trench;

a first left connection layer, covering a part of the left end face of the material, and the top laminar electrode and bottom laminar electrode proximate to the left end face, for electrically connecting the top laminar electrode and the bottom laminar electrode;

a first right connection, covering a part of the right end face of the material, and the top laminar electrode and bottom laminar electrode proximate to the right end face, for electrically connecting the top laminar electrode and the bottom laminar electrode;

a second left connection layer, covering the first left connection layer to serve as a first contact point; and a second right connection, covering the first right connection to serve as a second contact point.

7. The device according to claim 6, wherein the first left connection layer covers 15 to 95% of an entire area of the left end face of the material and the first right connection layer covers 15 to 95% of an entire area of the right end face of the material.

8. The device according to claim 6, wherein the first left connection layer covers 30 to 80% of an entire area of the left end face of the material and the first right connection layer covers 30 to 80% of an entire area of the right end face of the material.

9. The device according to claim 6, wherein the first left connection layer covers 35 to 50% of an entire area of the left end face of the material and the first right connection layer covers 35 to 50% of an entire area of the right end face of the material.

10. A method for manufacturing the resetable over-current protection devices of claim 6, comprising the steps of:

(a) providing a resistance variable sheet having a top laminar electrode and a bottom laminar electrode;

(b) cutting the sheet into a plurality of strips, each strip having: a top surface, a bottom surface, a left end face and a right end face;

(c) removing a part of the top laminar electrode of each of the strips along a longitudinal direction of the sheet to form a top trench, for exposing a part of the sheet;

(d) removing a part of the bottom laminar electrode of each of the strips along a longitudinal direction of the sheet to form a bottom trench, for exposing a part of the sheet;

(e) covering a part of the top laminar electrode and the top trench with a top insulation layer;

(f) covering a part of the bottom laminar electrode with a bottom insulation layer and the bottom trench;

(g) covering each of the top laminar electrode and the bottom laminar electrode proximate to the left end face, and a part of the left end of each of the strips with first left connection layers, for electrically connecting the top laminar electrode and the bottom laminar electrode;

(h) covering each of the top laminar electrode and the bottom laminar electrode proximate to the right end face, and a part of the right end of each of the strips with first right connection layers, for electrically connecting the top laminar electrode and the bottom laminar electrode;

(i) covering each of the first left connection layers with second left connection layers serving as a first contact point;

(j) covering each of the first right connections with second right connections serving as a second contact point; and (k) cutting each of the strips to form a plurality of resetable over-current protection devices.

11. A resetable over-current protection device, comprising:

a resistance variable material having a top surface, a bottom surface, a left end face, and a right end face;

a top laminar electrode disposed on the top surface, the top laminar electrode having a top trench for exposing a part of the material;

a bottom laminar electrode disposed on the bottom surface;

a top insulation layer covering a part of the top laminar electrode and the top trench;

a bottom insulation layer covering a part of the bottom laminar electrode;

a first left connection layer, covering the top laminar electrode and the bottom laminar electrode proximate to the left end face, and the material proximate to the left end face and the right end face, for electrically connecting the top laminar electrode and the bottom laminar electrode;

a first right connection, covering the top laminar electrode proximate to the right end face;

a second left connection layer, covering the first left connection layer to serve as a first contact point; and a second right connection, covering the first right connection to serve as a second contact point.

12. A method for manufacturing the resetable over-current protection devices of claim 11, comprising the steps of:

(a) providing a resistance variable sheet having a top laminar electrode and a bottom laminar electrode;

(b) cutting the sheet into a plurality of strips, each strip having: a top surface, a bottom surface, a left end face and a right end face;

(c) removing a part of the top laminar electrode of each of the strips along a transverse direction of the sheet to form a plurality of top trenches, for exposing parts of the sheet;

(d) covering a part of the top laminar electrode and the top trench with a top insulation layer;

(e) covering a part of the bottom laminar electrode with a bottom insulation layer;

(f) covering each of the top laminar electrode, the bottom laminar electrode, the left end face and the right end face with first left connection layers to form a plurality of looped connection layers, for electrically connecting the top laminar electrode and the bottom laminar electrode;

(g) covering each of the first left connection layers with second left connection layers serving as a contact point; and (j) cutting each of the strips to form a plurality of resetable over-current protection devices.

13. A resetable over-current protection device, comprising:

a resistance variable material, having: a top surface, a bottom surface, a left end face, and a right end face;

a top laminar electrode disposed above the top surface, the top laminar electrode having a top trench for exposing a part of the material;

a bottom laminar electrode disposed above the bottom surface, the bottom laminar electrode having a bottom trench for exposing a part of the material;

a top insulation layer covering a part of the top laminar electrode and the top trench;

a bottom insulation layer covering a part of the bottom laminar electrode and the bottom trench;

a first left connection layer, covering the top laminar electrode and the bottom laminar electrode proximate to the left end face, and the material proximate to the left end face and the right end face, for electrically connecting the top laminar electrode and the bottom laminar electrode;

a first right connection layer, covering the top laminar electrode and the bottom laminar electrode proximate to the right end face, and the material proximate to the left end face and the right end face, for electrically connecting the top laminar electrode and the bottom laminar electrode;

a second left connection layer, covering the first left connection layer to serve as a first contact point; and a second right connection, covering the first right connection to serve as a second contact point.

14. A method for manufacturing resetable over-current protection devices of claim 13, comprising the steps of:

(a) providing a resistance variable sheet having a top laminar electrode and a bottom laminar electrode;

(b) cutting the sheet into a plurality of strips, each strip having: a top surface, a bottom surface, a left end face and a right end face;

(c) removing a part of the top laminar electrode of each of the strips along a transverse direction of the sheet to form a plurality of top trenches, for exposing parts of the sheet;

(d) removing a part of the bottom laminar electrode of each of the strips along a transverse direction of the sheet to form a plurality of bottom trenches, for exposing parts of the sheet;

(e) covering a part of the top laminar electrode and the top trench with a top insulation layer;

(f) covering a part of the bottom laminar electrode with a bottom insulation layer and the bottom trenches;

(g) covering each of the top laminar electrode, the bottom laminar electrode, the left end face and the right end face with first left connection layers to form a plurality of looped connection layers, for electrically connecting the top laminar electrode and the bottom laminar electrode;

(h) covering each of the top laminar electrode, the bottom laminar electrode, the left end face and the right end face of each of the strips with first right connection layers, whereby each of the first right connections electrically connects the top laminar electrode and the bottom laminar electrode;

(i) covering each of the first left connection layers with second left connection layers serving as a first contact point;

(j) covering each of the first right connections with second right connections serving as a second contact point; and (k) cutting each of the strips to form a plurality of resetable over-current protection devices.

* * * * *